US012534828B2

(12) United States Patent
Fare'

(10) Patent No.: US 12,534,828 B2
(45) Date of Patent: Jan. 27, 2026

(54) SPINNING HEAD AND RELATED APPARATUS FOR THE PRODUCTION OF FILAMENTS

(71) Applicant: FARE' S.P.A. a socio unico, Fagnano Olona (IT)

(72) Inventor: Rosaldo Fare', Fagnano Olona (IT)

(73) Assignee: FARE' S.P.A. a socio unico, Fagnano Olona VA (IT)

( * ) Notice: Subject to any disclaimer, the term of this patent is extended or adjusted under 35 U.S.C. 154(b) by 159 days.

(21) Appl. No.: 18/481,432

(22) Filed: Oct. 5, 2023

(65) Prior Publication Data

US 2025/0116037 A1 Apr. 10, 2025

(30) Foreign Application Priority Data

Oct. 4, 2023 (EP) ..... 23201659

(51) Int. Cl.

| | |
|---|---|
| ***D01D 5/088*** | (2006.01) |
| ***D01D 4/02*** | (2006.01) |
| ***D01D 5/16*** | (2006.01) |
| ***D01D 7/00*** | (2006.01) |
| ***D01D 10/04*** | (2006.01) |
| ***D02J 1/22*** | (2006.01) |
| ***D04H 3/03*** | (2012.01) |
| ***D04H 3/033*** | (2012.01) |

(52) U.S. Cl.

CPC ..... *D01D 10/0436* (2013.01); *D01D 4/02* (2013.01); *D01D 7/00* (2013.01); *D02J 1/225* (2013.01); *D04H 3/033* (2013.01)

(58) Field of Classification Search

CPC ..... D01D 4/02; D01D 5/088; D01D 5/16; D01D 7/00; D02J 1/22; D02J 1/225; D04H 3/03; D04H 3/033

USPC ..... 264/103, 210.8, 211.12, 555; 425/66, 425/72.2, 377, 378.2, 382.2, 464; 28/245

See application file for complete search history.

(56) References Cited

U.S. PATENT DOCUMENTS

| | | | | |
|---|---|---|---|---|
| 4,107,364 | A | 8/1978 | Sisson | |
| 5,538,682 | A * | 7/1996 | Bornmann | D04H 3/03 264/210.8 |
| 2002/0104608 | A1* | 8/2002 | Welch | D01D 5/16 156/191 |
| 2007/0045905 | A1* | 3/2007 | Venturino | D04H 1/43835 264/555 X |
| 2015/0299921 | A1* | 10/2015 | Sommer | D01D 11/00 425/66 |

FOREIGN PATENT DOCUMENTS

| | | | |
|---|---|---|---|
| JP | 2013224505 | A | 10/2013 |
| KR | 20030034070 | A | 5/2003 |

OTHER PUBLICATIONS

European search report and written opinion issued by the EPO on Apr. 16, 2024 for priority European Patent Application No. 23201659.2.

* cited by examiner

*Primary Examiner* — Leo B Tentoni

(57) ABSTRACT

Apparatus (1) for producing a nonwoven fabric comprising a spinneret (2) and a mechanical drawing device (5) which comprises primary rollers and secondary rollers (21, 22) which are constrained to a frame (50) such that, considering a condition of use, said secondary rollers (21, 22) are movable with respect to said primary rollers (11, 12, 13) between a first position of operational disengagement from said filaments (3), and a second drawing position of said filaments (3).

18 Claims, 7 Drawing Sheets

SPINNING HEAD AND RELATED APPARATUS FOR THE PRODUCTION OF FILAMENTS

CROSS-REFERENCE TO RELATED APPLICATION

This application claims priority to and the benefit of European Application 23201659.2 filed 4 Oct. 2023 the contents of which are incorporated herein by reference in their entirety.

The present invention relates to an apparatus for producing nonwoven fabrics, in particular but not exclusively for the geotextile field.

Specifically, the present invention concerns the system of drawing the filaments exiting the spinneret.

In particular, in the geotextile field, methods for making nonwoven fabrics, typically of polypropylene, are known. However, fibers commonly used in the field of nonwoven fabrics have mechanical properties that are not satisfactory for this specific use.

In particular, the applicant has observed that aerodynamic drawing systems, commonly used in the field of nonwoven fabrics, do not provide the fibers with the desired properties.

Thus, object of the present invention is to provide an apparatus and method for producing a nonwoven fabric, typically for the geotextile field, having filaments with mechanical properties satisfactory for that field.

These and other objects are solved by the present invention by means of an apparatus according to one or more of the appended claims.

In particular, the present invention relates to an apparatus and a method according to the independent claims, while preferred aspects are set forth in the dependent claims.

According to an aspect, an apparatus for producing a nonwoven fabric comprises a spinneret for extruding a plurality of filaments, a cooling device arranged, in use, below the spinneret, a mechanical drawing device arranged below the cooling device, and a collecting device to collect filaments which is arranged below the drawing device. The drawing device comprises at least two primary rollers, each rotatable about its own axis of rotation, and one or more secondary rollers, preferably two or more secondary rollers, and each of the secondary rollers is rotatable about its own axis of rotation. The drawing device further comprises a frame and the primary and secondary rollers are constrained to the frame so that, considering a condition of use, the secondary rollers are movable with respect to the primary rollers between a first position of operational disengagement from the filaments, and a second position of filament drawing. The primary rollers and the secondary rollers are arranged alternately with each other so that, in use, the filaments alternately meet a primary roller and a secondary roller and so that, in the second drawing position, the filaments meet rollers arranged at distances progressively decreasing with respect to the collecting device. The tangential speed of the roller placed furthest upstream in the filament path is between 300 and 2000 m/min and the tangential speed of the rollers is progressively increasing. In particular, as the speed of the rollers increases, each roller has a higher tangential speed than the roller arranged immediately upstream in the path of the filaments 3.

The arrangement and speed of the rollers allow the filaments processed by the drawing device to be provided with the desired mechanical properties.

The distance from the collecting device is measured along the feed direction of the filaments between the rollers and the collecting device, or otherwise in a direction that, in use, corresponds to a vertical direction.

The distance between a roller and the collecting device can be measured from the surface of the collecting device on which the filaments are deposited and the surface of the roller, at the point where this distance has the smallest value (i.e., from the point of the roller closest to the collecting device).

It should be noted that the collecting device is discussed to be downstream of the drawing device.

According to a possible aspect, the collecting device comprises a suction element placed below the collection surface and adapted to suction gas below said surface.

According to a possible aspect, the suction element is connected to an aspirator adapted to suction gas at a speed between 8 m/s and 25 m/s, preferably between 12 m/s and 15 m/s.

According to a possible aspect, the width of the suction element is between 100 mm and 500 mm, preferably it is 250 mm.

The width of the suction element is defined as the distance between the two side ends of the suction element in a direction parallel to the collection surface of the collecting device.

According to a possible aspect, considering a sectional plane perpendicular to the axis of rotation of at least one of the primary rollers and considering, on this sectional plane, a straight line tangent both to the axis of rotation of the primary roller placed, in use, furthest upstream in the path of the filaments (i.e., of the first primary roller met by the filaments) and to the axis of rotation of the primary roller placed, in use, furthest downstream in the path of the filaments (i.e., of the last primary roller met by the filaments), the sectional plane is divided by this straight line into two half-planes. The frame of the first and secondary rollers is mainly arranged in one of these half-planes, preferably at least 70% of the area of the frame on said sectional plane is arranged in one of these half-planes.

"Mainly" is intended to mean a value of the area of more than 50%. In possible embodiments, this value exceeds 80%.

In other words, considering a straight line passing through the axes of rotation of the furthest upstream roller and the furthest downstream roller, at least 50%, preferably at least 70%, more preferably at least 80% of the frame is arranged to the left or right of this straight line.

Preferably, this property is not limited to only one of the possible planes of sections passing through the frame. In fact, if a reference plane perpendicular to the sectional plane and comprising this tangent straight line is considered, two portions of space are formed, whereby the frame is primarily arranged in one of those portions of space, preferably at least 70% of the volume of the frame being arranged in one of these portions of space.

Mainly means a volume greater than 50%.

In other words, considering a reference plane as described above, at least 50%, preferably at least 70%, more preferably at least 80% of the volume of the frame is arranged to the left or right of this plane.

It should be noted that this feature is configured in such a way that the frame is mainly arranged on one side of the filaments, i.e., considering a sectional plane which crosses the frame and which is arranged perpendicular to the axis of rotation of one of the rollers, the frame is mainly to the right or left of the filaments.

This makes it possible to simplify the construction of the frame, which is also very compact. A single frame, which supports both the primary rollers and the secondary rollers and is mainly arranged as discussed above, further allows easier control of the mutual position of the primary rollers and the secondary rollers.

In fact, a secondary roller can be constrained to the same frame as a primary roller, and the constraint between the secondary roller and the frame can be made nearby a primary roller.

It should be noted that the axes of rotation of the primary and secondary rollers are typically parallel to each other, that is, there is a plane perpendicular to all the axes of rotation of the primary and secondary rollers.

Primary and secondary rollers are preferably aligned with each other. Therefore, the axes of rotation of the primary rollers are typically arranged (in a plane perpendicular to these axes) on a straight, preferably vertical line, considering the condition of use of the apparatus.

The secondary rollers, in the case of a plurality of secondary rollers, are also preferably aligned with each other. Typically, the line joining the axes of rotation of the secondary rollers is vertical, considering a condition of use of the apparatus.

Preferred embodiments comprise three primary rollers and two secondary rollers.

It should be noted that, for the sake of simplicity, properties of the "secondary rollers" will now be discussed as if they were several. These properties also apply to embodiments equipped with a single secondary roller.

As discussed, first and secondary rollers are movable with each other.

In possible embodiments, at least one secondary roller (preferably each secondary roller) is translationally constrained to the frame by a translatable element, i.e., a slide, and the translation of the slide defines the aforementioned first and second positions.

In possible embodiments, at least one secondary roller (preferably each secondary roller) is mounted on a body that is at least rotationally constrained to the frame, and the rotation of the body defines the aforementioned first and second positions. Therefore, the rotation of the body with respect to the frame typically causes at least one movement along a circular trajectory with respect to the frame.

According to an aspect, the tangential speed of each roller is at least 10% higher than the speed of the roller placed immediately upstream thereof, considering the direction of movement of said filaments. As apparent to a field technician, the roller placed immediately upstream with respect to the one being considered is the roller that the filaments meet immediately before the one being considered (i.e., without the filament meeting any interposed rollers). Obviously, the aforementioned property of the tangential speed does not apply to the first roller met by the filaments, which cannot satisfy this property, since there is no roller placed further upstream of it, and thus no reference tangential speed.

Preferably, the tangential speed of each roller is between 110% and 200% of the tangential speed of the roller placed upstream thereof, considering the direction of movement of the filaments. As above, this property clearly cannot apply to the first of the rollers met by the filaments in their path.

In fact, the speed of this first roller cannot be compared with a preceding roller (since this one does not exist). In possible embodiments, however, the tangential speed of this roller can be adjusted between 300 and 2000 m/min so that the speed of the filaments passing through the first roller is between 300 m/min and 1000 m/min.

These properties of the tangential speeds led to the best results in terms of the properties of the filaments processed by the drawing device (particularly as for the molecular orientation thus obtained).

According to a possible embodiment, the apparatus comprises an expansion duct arranged below the drawing device and above the collecting device, said expansion duct comprises at least two planes inclined with respect to the collection surface of the collecting device. Said expansion duct further comprises an inlet port and an outlet port.

The term 'inclined planes' refers to planes that are inclined with respect to the central axis of the expansion duct.

The term "inlet port" means the section defined on a plane perpendicular to the central axis of the expansion duct and arranged on the upper end from the inclined planes facing the drawing device.

The term "outlet port" means the section defined on a plane perpendicular to the central axis of the expansion duct and arranged on the lower end of the expansion duct.

The inclination of the inclined planes allows the section of the inlet port and the section of the outlet port of the expansion duct to be adjusted.

By adjusting the inclination of the planes, the filaments can be moved within the expansion duct in such a way that, during the next step of depositing the filaments, the area in which the filaments are deposited on the surface of the collecting device increases.

According to a possible aspect, the width of the inlet port is between 25 mm and 120 mm, preferably it is 60 mm.

Width of the inlet port means the distance between the inclined shelves along a straight line lying on a plane passing through the side ends of the inlet port.

According to a possible aspect, the width of the outlet port is between 130 mm and 350 mm, preferably it is 250 mm.

Similar to what has been described above, the width of the outlet port is defined as the distance between the inclined shelves along a straight line lying on a plane which passes through the side ends of the outlet port.

According to a possible aspect, the height of the expansion duct is between 500 mm and 2000 mm, preferably it is 1000 mm.

The height of the expansion duct is defined as the distance between the inlet port and the outlet port, measured along a direction parallel to the center axis of the expansion duct.

According to a possible aspect, the outlet port of the expansion duct is placed at a distance from the collection surface of the collecting device of between 20 mm and 180 mm, preferably it is 50 mm.

The distance between the outlet port of the expansion duct and the collection surface of the collecting device is measured along a straight line perpendicular to the collection surface of the collecting device.

According to an alternative embodiment, the apparatus comprises a suctioning tube arranged below the drawing device and a mechanical distributor placed below said suctioning tube, said mechanical distributor being configured so that the filaments exiting the suctioning tube come into contact with said mechanical distributor before being deposited on the collection surface. This allows to increase the spatial distribution of filament deposition on the collection surface of the collecting device.

In other words by means of the mechanical distributor, the filaments falling on the collection surface can be spread over a larger area in comparison to a condition wherein the mechanical distributor is absent.

According to a possible aspect, the mechanical distributor comprises a movable shelf.

As the filaments exiting the suctioning tube come into contact with the movable shelf, the direction of filament movement is altered so as to increase the area where the filaments are deposited on the collection surface of the collecting device.

Alternatively, according to a possible aspect, the mechanical distributor comprises a fixed shelf placed below the suctioning tube and a swinging rod at the side of said fixed shelf.

The filaments exiting the suctioning tube come into contact with the fixed shelf, thus changing the direction of filament fall and subsequently coming into contact with the swinging rod, which causes the falling filaments to swing before they are deposited on the collection surface of the collecting device.

This has the advantage of increasing the area over which the filaments are deposited on the collection surface.

An aspect of the present invention further relates to a process for making a nonwoven fabric by means of an apparatus according to one or more of the preceding aspects, comprising the steps of extruding a plurality of filaments from the spinneret, cooling the filaments by means of the cooling device, drawing the filaments by means of the mechanical drawing device 5 thereby obtaining a molecular orientation, in which the filaments alternately meet a primary roller and a secondary roller. The filaments meet rollers arranged at a distance progressively decreasing with respect to the collecting device, and the tangential speed of the roller placed furthest upstream in the filament path is between 300 and 2000 m/min. The tangential speed of the rollers is progressively increasing.

Hereinafter, referring to the appended figures, exemplary and non-limiting embodiments of the present invention will be described, in which.

Figure 1:
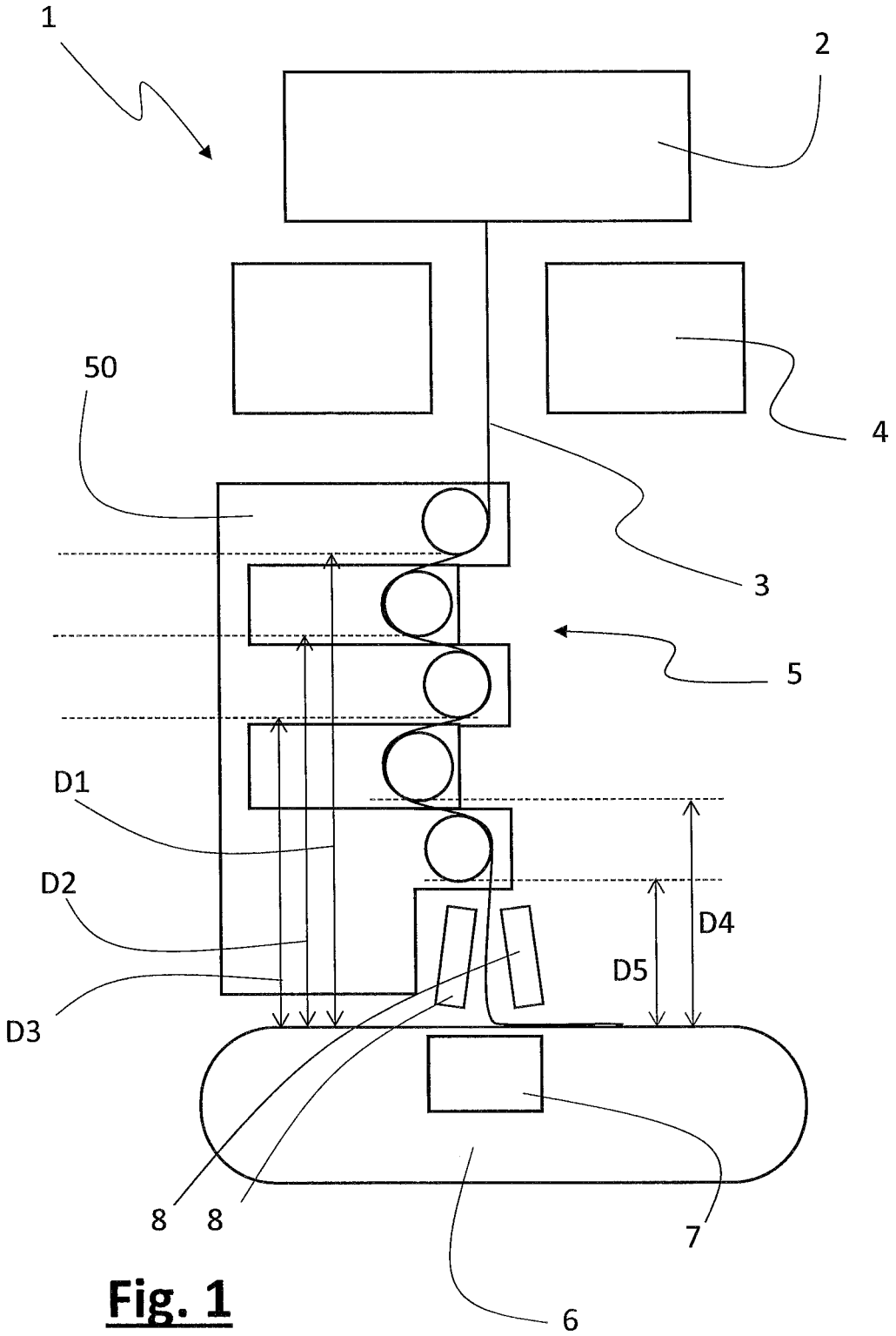
FIG. 1 is a schematic side view of a possible embodiment of an apparatus according to the present invention.
Figure 2:
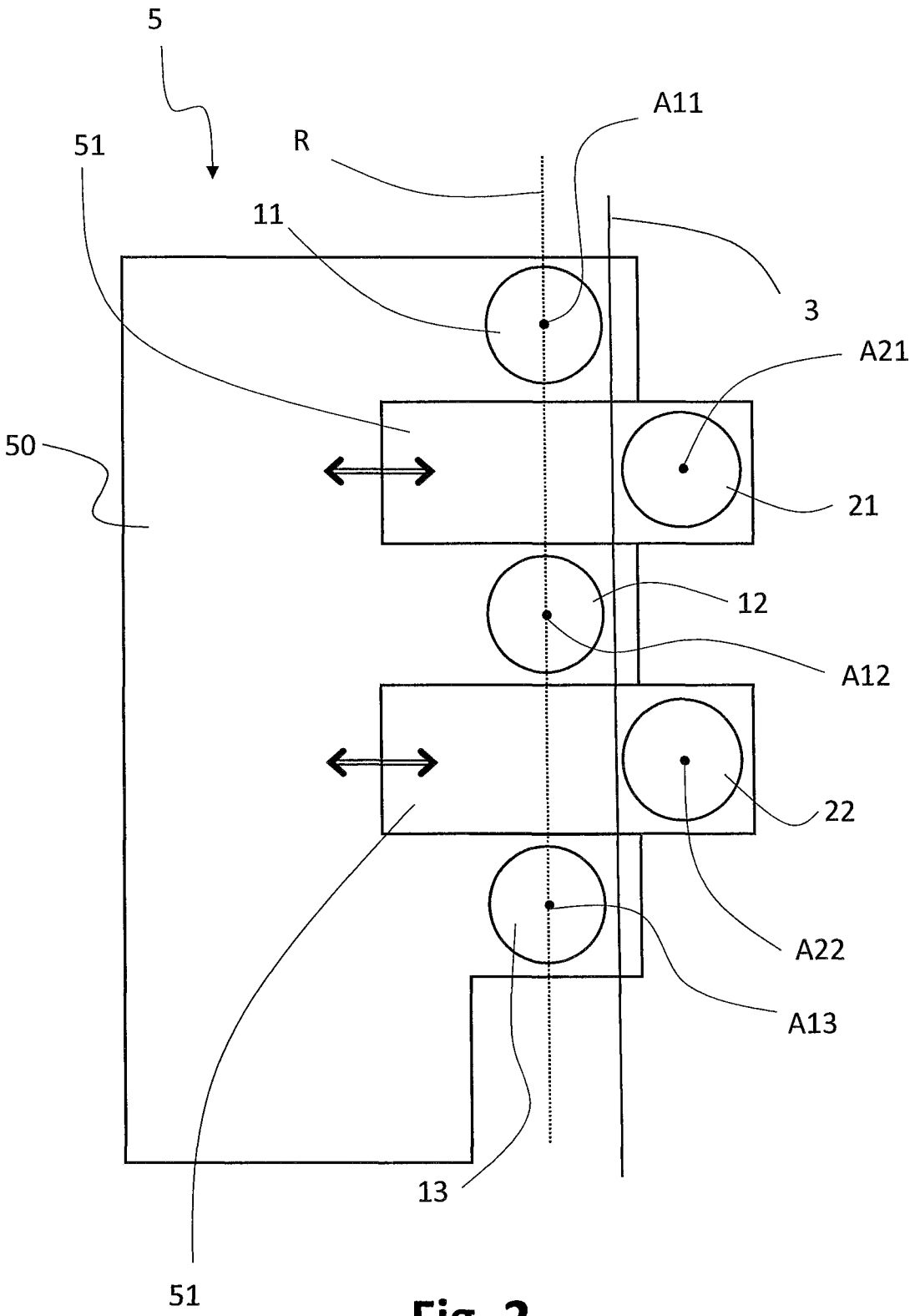
FIGS. 2 and 3 are schematic views of the drawing device of the apparatus in FIG. 1, with the secondary rollers in the first and second positions, respectively.

An apparatus 1 for the production of a nonwoven fabric comprises a spinneret 2 for extruding a plurality of filaments 3, a cooling device 4 arranged, in use, below the spinneret 2, a mechanical drawing device 5 (hereinafter also "drawing device 5") arranged below the cooling device, and a collecting device 6 to collect the filaments which is arranged below the drawing device 5.

The spinneret 2, the cooling device 4 can be made according to what known to the field technician and are not discussed in detail herein.

In short, the spinneret 2 is typically able to receive molten material and to extrude a plurality of filaments 3 through extrusion holes not shown in detail in the figures.

It should be noted that, for the sake of simplicity, the figures only show one bundle of filaments, which is directed substantially vertically from the spinneret 2 towards the drawing device 5. Actually, the filaments 3 may initially be distributed more widely and converge from the spinneret 2 at the drawing device. The spinneret is preferably a linear spinneret.

The cooling device 4 is typically configured to direct one or more flows of gas, typically air, towards the filaments 3 extruded from the spinneret 2, in order to cause them to cool. Typically, when the filaments come into contact with the drawing device 5, they are substantially at room temperature or at least substantially solid.

Additional suctioning devices, not shown in detail, can be provided below the spinneret for suctioning harmful gases such as oligomers and the like formed by the extrusion process of the filaments 3.

The collecting device 6 typically has a collection surface, such as a belt, which is typically movable in a horizontal direction and is adapted to collect the falling filaments and form a nonwoven fabric. Thanks to the collection surface, the nonwoven fabric can be directed towards further processing (e.g., suitable for consolidating the nonwoven fabric, such as one or more needle-felting devices, one or more calenders, etc.).

The collecting device 6 may comprise a suction element 7 below the collection surface of the collecting device 6. This suction element 7 allows gas to be suctioned below the collection surface.

The suction element 7 is connected to an aspirator adapted to suction gas at a speed between 8 m/s and 15 m/s, preferably between 12 m/s and 15 m/s.

The width of the suction element 7 and, accordingly, the width of the suction area on the collection surface of the collecting device is between 100 mm and 500 mm, preferably it is 250 mm.

It should be noted that the collecting device 6 is not necessarily the first device downstream of the drawing device 5, since additional processing, known in the art, can be provided on the falling filaments as better described below.

The drawing device 5 comprises a plurality of rollers 11, 12, 13, 21, 22, specifically primary rollers 11, 12, 13, and one or more secondary rollers 21, 22, mounted on a frame 50.

Each roller 11, 12, 13, 22, 23 is rotatable with respect to the frame 50 about an axis of rotation A11, A12, A13, A21, A22.

The primary rollers and the secondary rollers 11-13, 21, 22 are constrained so as to allow mutual movement between secondary rollers and primary rollers.

The primary rollers 11-13 are typically fixedly constrained to the frame 50, i.e., with no possibility of translation, the only degree of freedom being given by the rotation about their own axis A11, A12, A13.

In contrast, the secondary rollers 21, 22 are preferably movably constrained with respect to the frame 50. This can be achieved in various ways, according to known mechanical principles. Preferred embodiments provide secondary rollers constrained by means of the slides 51 translationally mounted to the frame 50, and/or by means of bodies 52 hinged to the frame 50. In the second case, the secondary rollers 21, 22 are constrained to the body 52 apart from the hinge which constrains the body 52 to the frame 50, so that the rotation of the body 52 with respect to the frame 50 causes the roller to move with respect to the frame 50, typically along a circular trajectory.

In general, the secondary rollers 21, 22 are movable with respect to the primary rollers 11-13 between a first position of operational disengagement from the filaments 3 and a second position of drawing the filaments 3. Thus, the second position is the one taken by the rollers during the operating condition of the apparatus 1, which allows the filaments 3 to be drawn. The first position is the rest position, in which the apparatus 1 is not operating or, in any case, in which the rollers do not draw the filaments 3. Typically, in this first position, the secondary rollers 21, 22 are not in contact with the filaments 3.

In the second position, the first and secondary rollers are in contact with the filaments 3. Preferably, in use, the filaments 3 do not wrap around the rollers 11, 12, 13, 21, 22 but are in contact only with a part of the outer surface of the rollers 11, 12, 13, 21, 22.

In other words, considering one of the rollers and a sectional plane perpendicular to the axis of rotation of that roller, the outer surface of the roller has a substantially circular shape. The filaments are in contact with only part of the circumference defined by the outer portion of the roller, that is, they are in contact only along an arc of the circle formed by the outer surface of the roller. The angle defined by this arc of a circle is therefore less than 360°.

Figure 3:
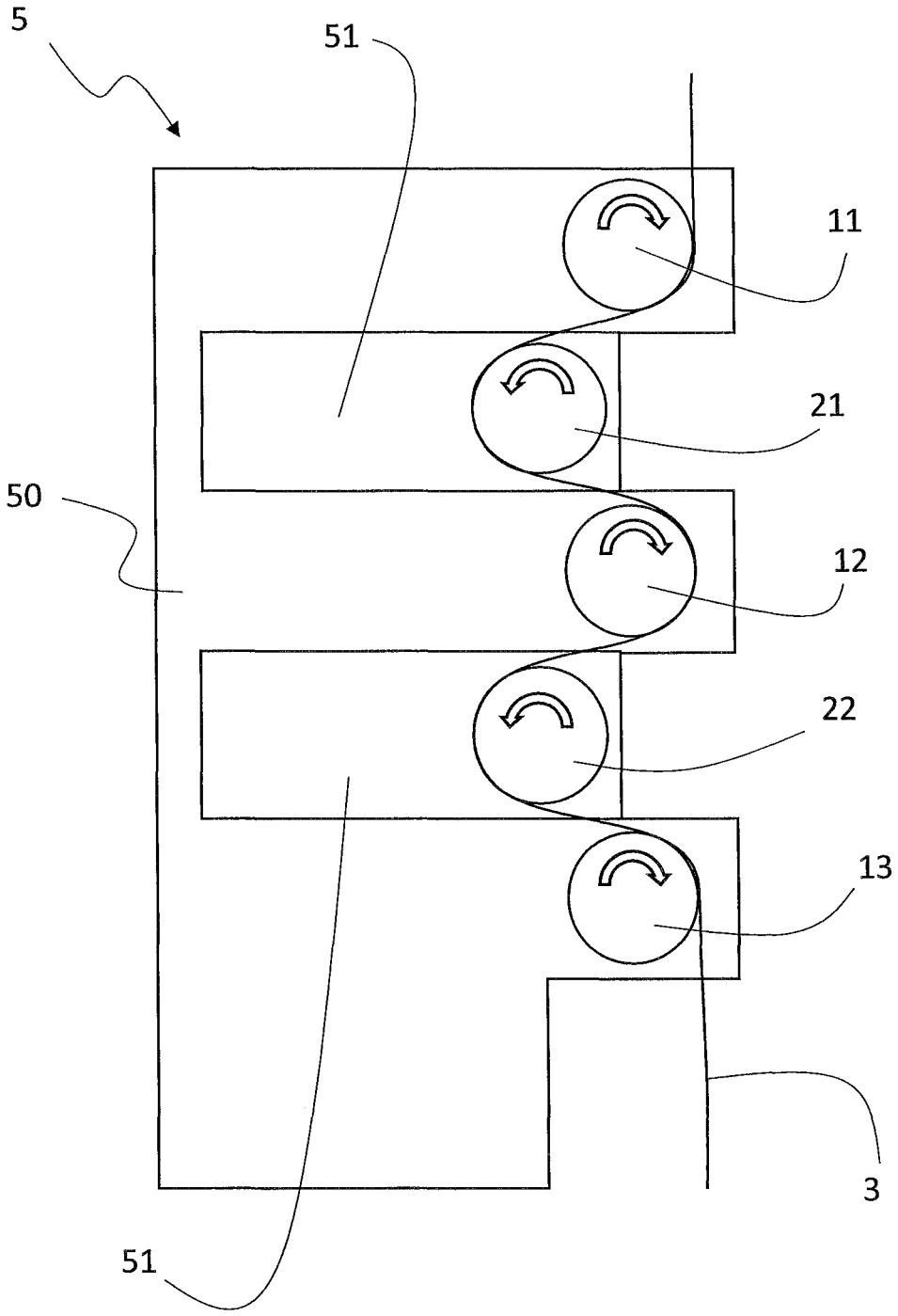
Figure 4:
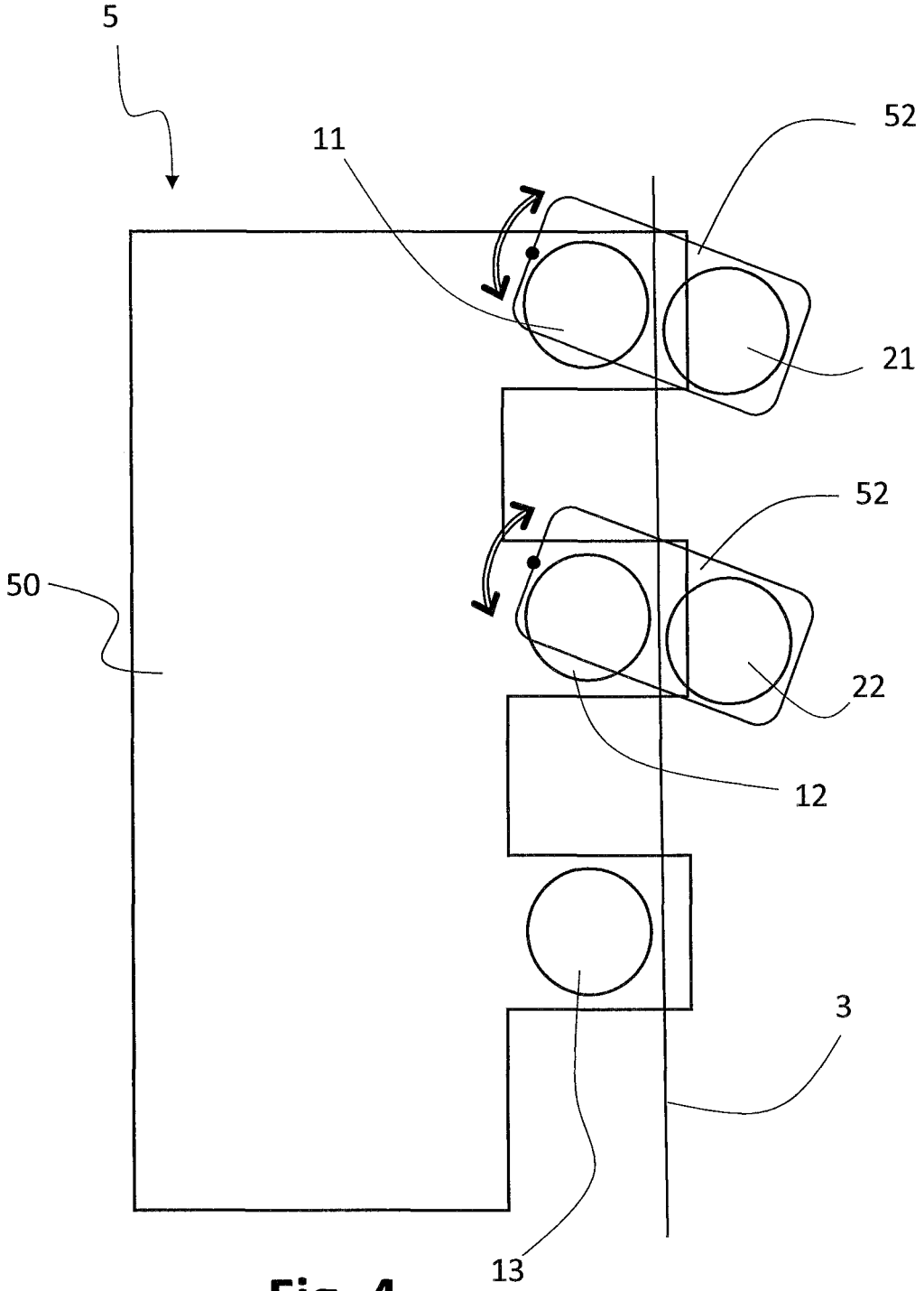
FIGS. 4 and 5 are schematic views of a drawing device of the apparatus according to an embodiment alternative to the one in FIG. 1, with the secondary rollers in the first and second positions, respectively.
Figure 5:
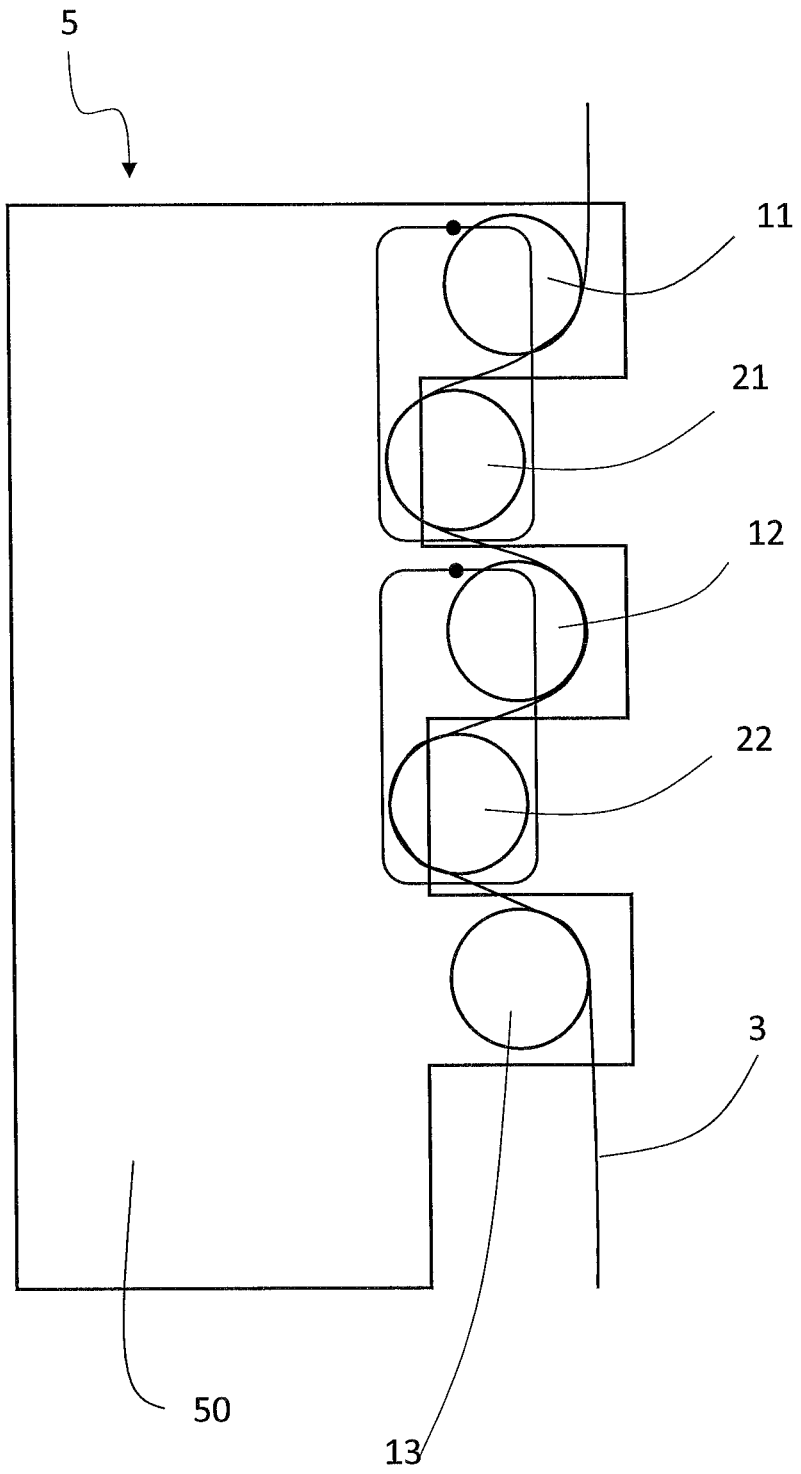
Figure 6:
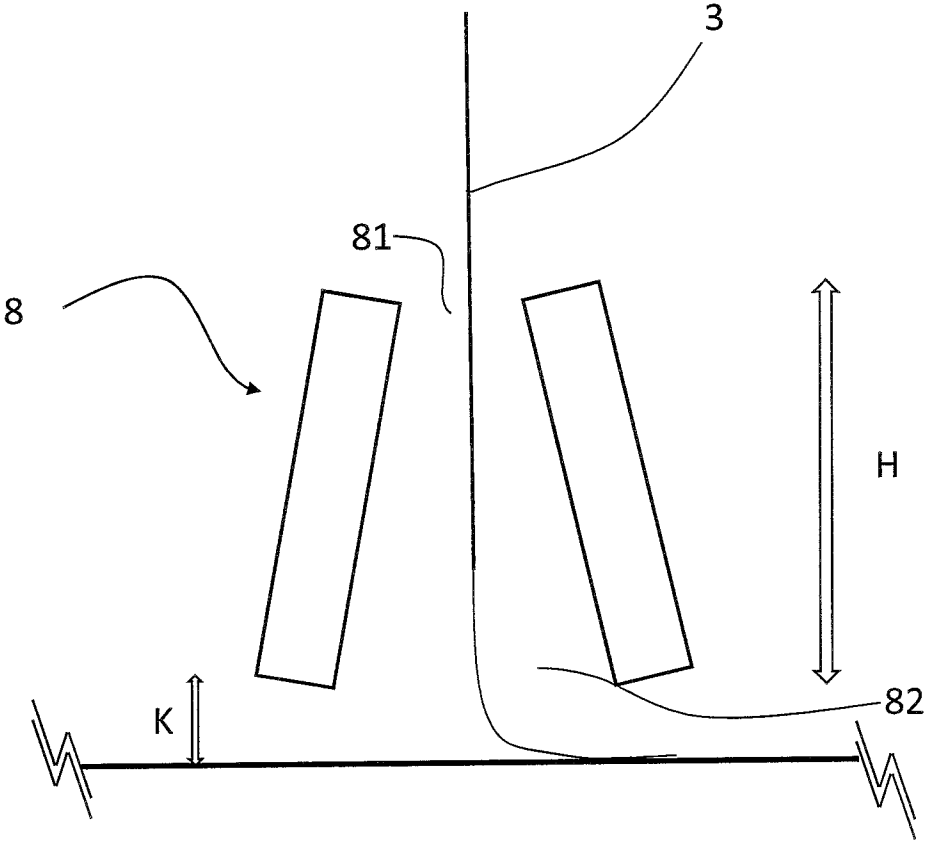
FIG. 6 is a schematic view of an expansion channel of an apparatus according to an embodiment.
Figure 8:
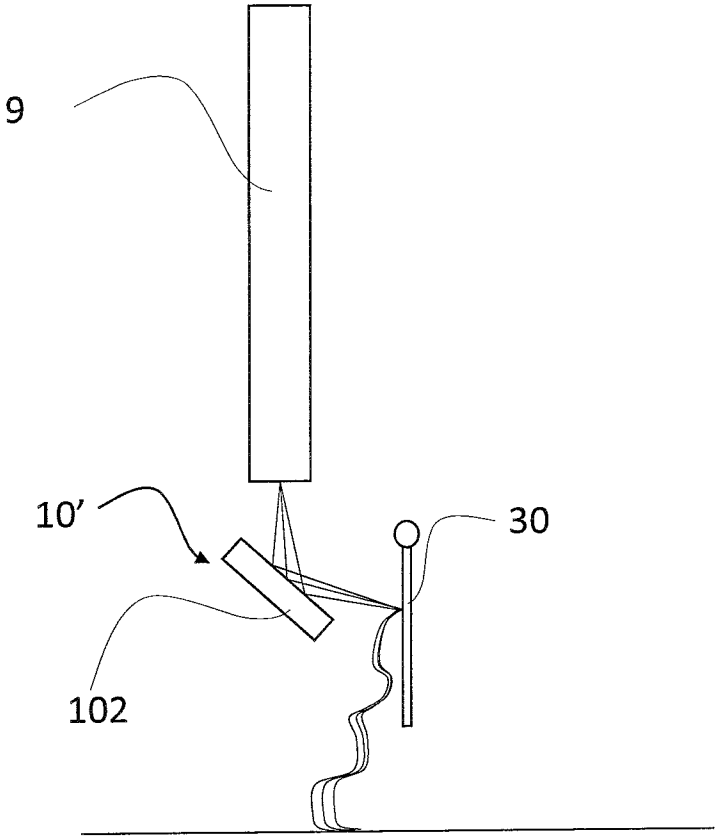
FIG. 8 is a schematic view of a suction channel and a mechanical distributor according to an embodiment alternative to the one of FIG. 7.
Figure 7:
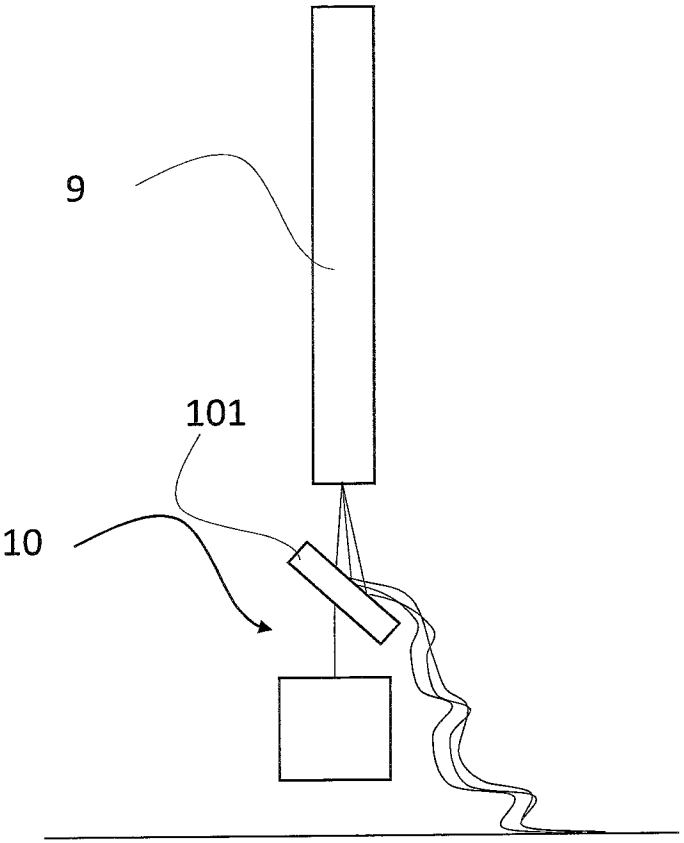
FIG. 7 is a schematic view of a suction channel and a mechanical distributor according to an embodiment.

For example, with reference to FIG. 3, at the primary roller 11 and the primary roller 13, the filaments 3 are in contact with these rollers along an arc extending through an angle of about 90°, while at the other rollers the filaments are in contact therewith along an arc of a circle extending through an angle of about 180°.

The primary rollers and the secondary rollers 11, 12, 13, 21, 22 are arranged alternately with each other so that, in use, the filaments alternately meet a primary roller and a secondary roller. Typically, the roller placed furthest upstream and the roller placed furthest downstream in the path of the filaments 3 are primary rollers, for example, the primary roller 11 and the primary roller 13 in the embodiment shown in the figures.

The rollers 11, 12, 13, 21, 22 are arranged so as to be progressively closer to the collecting device 6, that is, the filaments in their path meet rollers arranged at distances D1, D2, D3, D4, D5 progressively decreasing with respect to the collecting device.

As explained, the distance D1, D2, D3, D4, D5 between each roller (i.e., between its outer surface) and the collecting device is measured in the direction perpendicular to the collecting device, i.e., perpendicular to the surface of the collecting device 6 on which the filaments 3 are deposited. The roller furthest upstream in the path of the filaments 3 has the maximum value of this distance, while the roller furthest downstream has the minimum value of this distance.

Considering the condition of use, the rollers are arranged one below the other.

Preferably, in section, the axes of rotation A11, A12, A13 of the primary rollers are arranged on a straight line typically, in use, perpendicular to the collecting device (i.e., the surface on which the filaments are deposited) and/or substantially vertical.

In case of two or more secondary rollers 21, 22, also the axes of rotation A21, A22 of the secondary rollers are arranged on a straight line typically perpendicular to the collecting device (i.e., the surface on which the filaments are deposited) and/or substantially vertical in use.

The frame 50 is preferably configured to comply with the following property. Consider a sectional plane perpendicular to the axis of rotation A11, A12, A13 of at least one of the primary rollers 11, 12, 13 and a straight line R on this plane tangent to the axis of rotation A11 of the primary roller 11 which is placed, in use, furthest upstream in the path of the filaments and tangent to the axis of rotation A13 of the primary roller 13 which is placed furthest downstream in the path of the filament 3. The frame 50 is arranged mainly to the right or left of this straight line R, preferably at least 70% of the frame is arranged to the right or left of the straight line R.

The same can be said for the filaments 3. Consider the (typically curved) line formed by the path of the filaments 3 from the furthest upstream roller to the furthest downstream roller. Consider the portions of section of the frame 50 to the right and left of this line. One of the two portions is larger (i.e., has larger area) than the other, typically at least 70% larger than the other.

The property discussed above applies to at least one possible sectional plane. Since the frame is a three-dimensional object, an additional preferred property of the frame 50 can be defined. Given a reference plane passing through the straight line R (and perpendicular to the sectional plane), the frame 50 is divided into two portions by that reference plane. One of the two portions has greater volume than the other, preferably at least 70% greater, more preferably at least 80% greater.

In preferred embodiments, therefore, the frame is predominantly arranged on one side of such a reference plane and, generally, as a result on one side of the filaments 3.

Thus, the frame 50 is compact and is a single element arranged predominantly on one side of the filaments, while the rollers mounted on this frame are located, in the operating condition, alternately on the left and on the right of the filaments, considering a viewpoint aligned with the axis of rotation of at least one of the rollers, such as the view shown in the exemplary embodiments in the figures.

The roller furthest upstream in the path of the filaments 3, which in the embodiments is the primary roller 11, has tangential speeds between 300 and 2000 m/min. For example, this speed can be calculated by multiplying the angular speed of rotation of the roller, multiplied by the radius of the roller itself.

Both the primary rollers and the secondary rollers, which are downstream of the primary roller 11, preferably have progressively increasing speeds, typically each roller having a roller immediately upstream thereof has tangential speed at least 10% higher than the tangential speed of the roller immediately upstream thereof.

Preferably, the speed difference between two rollers arranged sequentially in the path of the filaments 3 does not exceed a predetermined threshold, whereby the tangential speed of a roller is between 110% and 200% of the speed of the roller placed immediately upstream thereof.

The rollers 11, 12, 13, 21, 22 are preferably heated to temperatures different from each other.

In use, a plurality of filaments 3 is extruded from the spinneret 2. The filaments 3 are then cooled by the cooling device 4.

Below the cooling device 4 the mechanical drawing device 5 is arranged.

The drawing device 5 is operated so that the secondary rollers 21, 22 are arranged in the second drawing position, so that the filaments are in contact with the various rollers 11, 12, 13, 21, 22 of the drawing device 5.

As explained, the filaments do not wrap completely around the rollers but are in contact with only part of the outer surface thereof. Typically, the filaments 3 have a basically "S" pattern between the various rollers 11, 12, 13, 21, 22 of the drawing device 5.

The filaments meet the primary and the secondary rollers alternately, so that following a primary roller 11, 12, 13 meet a secondary roller 21, 22 and vice versa.

The rollers 11, 12, 13, 21, 22 are rotationally operated so as to draw the filaments 3. As discussed, the rollers 11, 12, 13, 21, 22 typically have progressively increasing speeds, so that the speed of a roller is preferably between 110% and 200% of the speed value of the roller immediately upstream thereof.

The primary rollers 11, 12, 13 are typically rotated in the opposite direction with respect to the secondary rollers 21, 22.

After the drawing step, the filaments 3 are deposited on the collecting device 6 to form a nonwoven fabric.

As explained, additional devices can be provided between the mechanical drawing device 5 and the collecting device 6 so that additional processing can be made to the filaments 3 before they are deposited on the collecting device 6.

According to a possible aspect, between the mechanical drawing device 5 and the collecting device 6 there is an expansion duct 8 comprising at least two inclined planes and comprising an inlet port 81 and an outlet port 82.

The inclination of the inclined planes gives the expansion duct 8 a truncated cone shape whose lower base section (facing the collection surface of the collecting device 6) is greater than the upper base section (facing the drawing device 5).

The width of the inlet port 81 is between 25 mm and 120 mm, preferably it is 60 mm.

The width of the outlet port 82 is between 130 mm and 350 mm, preferably it is 250 mm.

The height H of the expansion duct 8 is between 500 mm and 2000 mm, preferably it is 1000 mm.

The distance K between the outlet port 82 of the expansion duct 8 and the collection surface of the collecting device 6 is between 20 mm and 180 mm, preferably it is 50 mm.

According to an alternative embodiment, between the drawing device 5 and the collecting device 6 there are a suctioning duct 9 and a mechanical distributor 10, 10'.

The mechanical distributor 10, 10' alters the direction of fall of the filaments 3 exiting the suctioning duct 9, in order to increase the deposition surface of the filaments 3 on the collection surface of the collecting device 6.

Preferably, the mechanical distributor 10, 10' may comprise a movable shelf 101 on which the filaments 3 exiting the suctioning duct 9 are laid and which alters the direction of fall of the filaments 3 on the collecting device 6.

According to an alternative embodiment the mechanical distributor 10, 10' may comprise a fixed shelf 102 placed below the suctioning tube 9 and a swinging rod 30 placed to the side of the fixed shelf 10'.

In this case, the filaments 3 exiting the suctioning duct 9 come into contact with the fixed plane 10' which alters the direction of fall of the filaments 3 which are then subject to swinging as a result of contact with the swinging rod 30 before being deposited on the collection surface of the collecting device 6.

The invention claimed is:

1. Apparatus (1) for producing a nonwoven fabric comprising a spinneret (2) for extruding a plurality of filaments (3), a cooling device (4) arranged, in use, below the spinneret (2), a mechanical drawing device (5) arranged below the cooling device, a collecting device (6) to collect the filaments which is arranged below the drawing device (5), the drawing device (5) comprising at least two primary rollers (11, 12, 13) each rotatable about its own axis of rotation (A11, A12, A13), and one or more secondary rollers (21, 22), the secondary rollers (21, 22) each being rotatable about its own axis of rotation (A21, A22), a frame (50), wherein said primary rollers (11, 12, 13) and said secondary rollers (21, 22) are constrained to said frame (50) such that, considering a condition of use, said secondary rollers (21, 22) are movable with respect to said primary rollers (11, 12, 13) between a first position of operational disengagement from said filaments (3), and a second drawing position of said filaments (3), and wherein said primary rollers (11, 12, 13) and said secondary rollers (21, 22) are arranged alternately with each other, so that, in use, the filaments (3) alternately meet a primary roller and a secondary roller, and so that, in the second drawing position, the filaments (3) meet rollers arranged at progressively decreasing distances (D1, D2, D3, D4, D5) from the collecting device (6), the tangential speed of the roller (11) which is placed furthest upstream in the path of the filaments (3) being between 300 and 1500 m/min, the tangential speed of the rollers progressively increasing, wherein said one or more of the secondary rollers is translationally constrained to said frame, by means of a slide, the translation of said slide defining said first and second position.

2. The apparatus (1) according to claim 1 configured so that, considering a sectional plane perpendicular to the axis of rotation (A11, A12, A13) of at least one of the primary rollers (11, 12, 13) and considering, on said sectional plane, a straight line (R) tangent both to the axis of rotation (A11) of the primary roller (11) which, in use, is located furthest upstream in the path of the filaments and to the axis of rotation (A13) of the primary roller (13) which, in use, is located furthest downstream in the path of the filaments (3), the sectional plane being divided into two half-planes by said straight line (R), the frame (50) of said primary and secondary rollers is mainly arranged in one of said half-planes.

3. The apparatus (1) according to claim 2, configured such that, considering a reference plane which is perpendicular to said sectional plane and which comprises said tangent straight line, so as to form two portions of space divided by said reference plane, the frame of said primary and secondary rollers is mainly arranged in one of said portions of space, at least 70% of the volume of said frame being arranged in one of said portions of space.

4. The apparatus (1) according to claim 1, wherein said primary rollers (11, 12, 13) are translationally integral with said frame (50).

5. The apparatus according to claim 1, wherein the tangential speed of each roller is at least 5% higher than the speed of the roller disposed immediately upstream thereof along the direction of movement of said filaments.

6. The apparatus according to claim 5, wherein the tangential speed of each roller is between 105% and 200% of the tangential speed of the roller disposed immediately upstream thereof along the direction of movement of said filaments.

7. The apparatus according to claim 1, configured so that, in use, the tangential speed of the roller furthest upstream in the path of the filaments is between 300 and 2000 m/min.

8. The apparatus according to claim 1, wherein between the mechanical drawing device (5) and the collecting device (6) there is an expansion duct (8) comprising at least two inclined planes and comprising an inlet port (81) and an outlet port (82).

9. The apparatus according to claim 8, wherein the inclination of the inclined planes gives the expansion duct (8) a truncated cone shape having a lower base section facing a collection surface of the collecting device (6) and an upper base section facing the drawing device (5), wherein the lower base section is greater than the upper base section.

10. The apparatus according to claim 1, wherein between the drawing device (5) and the collecting device 6 there is a suctioning duct 9 and a mechanical distributor (10, 10'); said mechanical distributor (10, 10') being configured to alter the direction of fall of the filaments (3) exiting the suctioning duct (9) in order to increase the deposition surface of the filaments (3) on the collection surface of the collecting device (6).

11. The apparatus according to claim 10, wherein said mechanical distributor (10, 10') comprises a movable shelf (101) on which the filaments (3) exiting the suctioning duct (9) are laid and which alters the direction of fall of the filaments (3) on the collecting device (6).

12. The apparatus according to claim 10, wherein said mechanical distributor (10, 10') comprises a fixed shelf (102) placed below the suctioning tube (9) and a swinging rod (30) placed to the side of the fixed shelf (10').

13. Process for making a nonwoven fabric by means of an apparatus (1) according to claim 1, comprising the steps of extruding a plurality of the filaments (3) from the spinneret (2), cooling the filaments by means of the cooling device (4), and drawing the filaments by means of the mechanical drawing device (5), wherein the filaments (3) alternately meet a primary roller and a secondary roller, the filaments (3) meeting rollers which are arranged at progressively decreasing distances (D1, D2, D3, D4) from the collecting device (6), wherein the tangential speed of the roller (11) placed furthest upstream in the path of the filaments (3) is between 300 and 2000 m/min, the tangential speed of the rollers progressively increasing.

14. The apparatus (1) according to claim 3, wherein said primary rollers (11, 12, 13) are translationally integral with said frame (50).

15. The apparatus according to claim 1, wherein said one or more of the secondary rollers are mounted on a body which is at least rotatably constrained to said frame, the rotation of said body defining said first and second positions.

16. The apparatus according to claim 15, wherein the tangential speed of each roller is at least 5% higher than the speed of the roller placed immediately upstream thereof, considering the direction of movement of said filaments.

17. The apparatus according to claim 4, wherein between the mechanical drawing device (5) and the collecting device (6) there is an expansion duct (8) comprising at least two inclined planes and comprising an inlet port (81) and an outlet port (82).

18. Apparatus (1) for producing a nonwoven fabric comprising a spinneret (2) for extruding a plurality of filaments (3), a cooling device (4) arranged, in use, below the spinneret (2), a mechanical drawing device (5) arranged below the cooling device, a collecting device (6) to collect the filaments which is arranged below the drawing device (5), the drawing device (5) comprising at least two primary rollers (11, 12, 13) each rotatable about its own axis of rotation (A11, A12, A13), and one or more secondary rollers (21, 22), the secondary rollers (21, 22) each being rotatable about its own axis of rotation (A21, A22), a frame (50), wherein said primary rollers (11, 12, 13) and said secondary rollers (21, 22) are constrained to said frame (50) such that, considering a condition of use, said secondary rollers (21, 22) are movable with respect to said primary rollers (11, 12, 13) between a first position of operational disengagement from said filaments (3), and a second drawing position of said filaments (3), and wherein said primary rollers (11, 12, 13) and said secondary rollers (21, 22) are arranged alternately with each other, so that, in use, the filaments (3) alternately meet a primary roller and a secondary roller, and so that, in the second drawing position, the filaments (3) meet rollers arranged at progressively decreasing distances (D1, D2, D3, D4, D5) from the collecting device (6), the tangential speed of the roller (11) which is placed furthest upstream in the path of the filaments (3) being between 300 and 1500 m/min, the tangential speed of the rollers progressively increasing, wherein said primary rollers (11, 12, 13) are translationally integral with said frame (50) and said one or more of the secondary rollers is translationally constrained to said frame, by means of a slide, the translation of said slide defining said first and second positions.

* * * * *